US006973954B2

(12) United States Patent
Ward

(10) Patent No.: US 6,973,954 B2
(45) Date of Patent: Dec. 13, 2005

(54) METHOD FOR MANUFACTURE OF GRAY CAST IRON FOR CRANKCASES AND CYLINDER HEADS

(75) Inventor: Joseph R. Ward, New Palestine, IN (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 58 days.

(21) Appl. No.: 10/027,071

(22) Filed: Dec. 20, 2001

(65) Prior Publication Data

US 2003/0116113 A1 Jun. 26, 2003

(51) Int. Cl.[7] ..... B22D 27/00
(52) U.S. Cl. ..... 164/58.1
(58) Field of Search ..... 164/57.1, 58.1, 164/59.1; 420/13, 15, 33, 42, 590

(56) References Cited

U.S. PATENT DOCUMENTS 3,299,482 A * 1/1967 Tache ..... 164/473
3,965,962 A * 6/1976 Tanaka et al. ..... 164/55.1
3,977,867 A 8/1976 Cochran et al.
4,072,511 A 2/1978 Coyle
4,493,359 A * 1/1985 Bostater et al. ..... 164/58.1
4,806,157 A * 2/1989 Subramanian ..... 75/537
4,969,428 A 11/1990 Donahue et al.
5,948,353 A * 9/1999 Lawrence et al. ..... 420/15

FOREIGN PATENT DOCUMENTS

GB 2 187 985 * 9/1987 ..... B22D 23/00

OTHER PUBLICATIONS

Janowak, J.F. and R.B. Gundlach, "A Modern Approach To Alloying Gray Iron," AFS Transactions, 1982, pp. 1-17, vol. 90.

Fuller, A.G., "Effect of Manganese And Sulfur On Mechanical Properties And Structure Of Flake Graphite Cast Irons," AFS Transactions, 1986, pp. 863-872, vol. 94.

* cited by examiner

*Primary Examiner*—Kevin P. Kerns
(74) *Attorney, Agent, or Firm*—Dennis Kelly Sullivan; Susan L. Lukasik; Jeffrey P. Calfa

(57) ABSTRACT

A method of casting parts with gray iron includes the steps of providing molten gray iron metal with controlled carbon, silicon, phosphorous, sulfur, manganese and chromium content; alloying said molten gray iron metal, prior to pouring, with tin to a total tin content of about 0.05% to about 0.10%; inoculating said molten tin-alloyed gray iron metal, prior to pouring, with a gray iron inoculant to an additional silicon addition of from about 0.10% to about 0.12%; and casting the gray iron part from said molten, tin-alloyed inoculated gray iron metal as son as possible after said inoculation.

14 Claims, 1 Drawing Sheet

METHOD FOR MANUFACTURE OF GRAY CAST IRON FOR CRANKCASES AND CYLINDER HEADS

FIELD OF THE INVENTION

Figure 1:
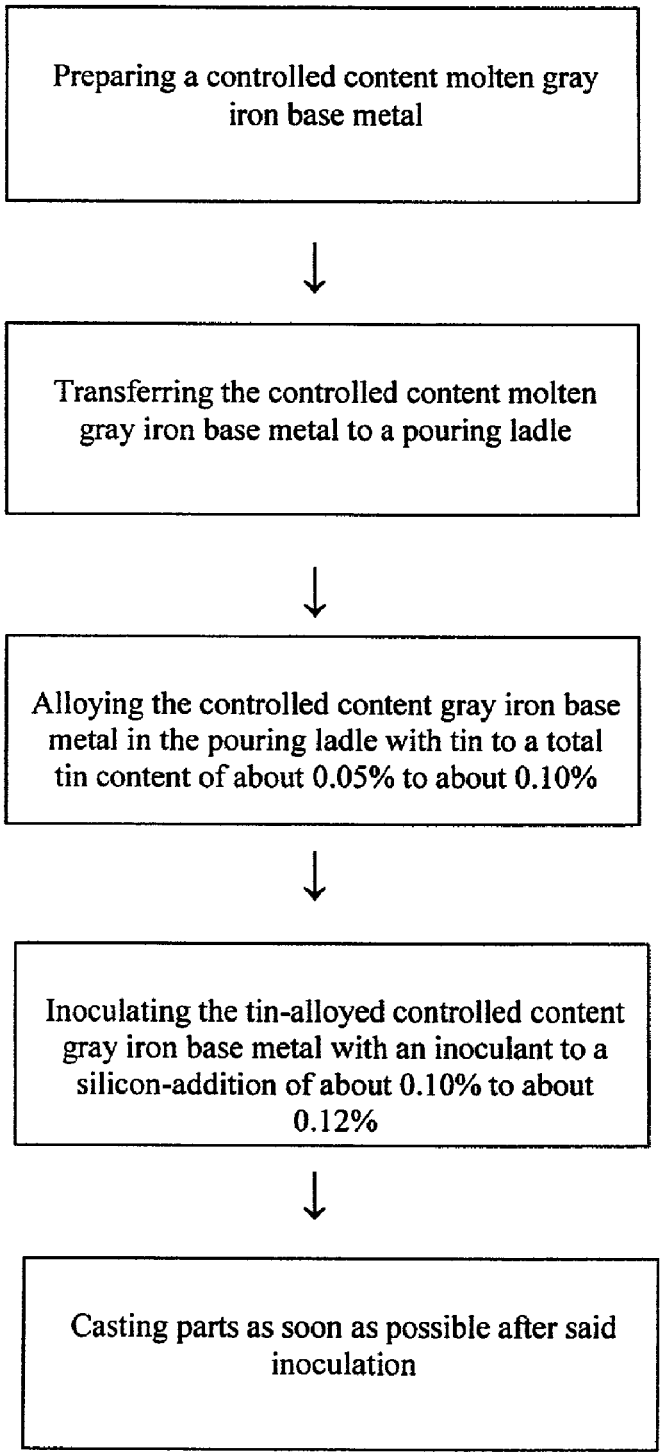

This invention relates to casting methods using gray cast iron, and more particularly to casting methods for the manufacture of crank cases and cylinder heads with gray cast iron.

BACKGROUND OF THE INVENTION

Gray iron is a desirable casting material because its excellent castability and low cost makes it versatile for the manufacture of products such as crank cases and cylinder heads. Such manufacturing components require high strength, soundness, good machinability, dimension stability and uniform properties. To obtain these qualities, it is important to achieve a uniform metallurgical structure throughout all sections of the casting and particularly a uniform pearlite structure. Alloys are commonly added to gray cast iron materials in the casting process in an effort to achieve these desirable properties, and the effect of alloying on gray iron has been extensively studied, as indicated, for example, by "A Modern Approach To Alloying Gray Iron," Janowak & Gundiach, AFS Transactions, Vol. 90, 1982, and "Effect of Manganese and Sulfur on Mechanical Properties and Structure of Flake Graphite Cast Irons," Fuller, AFS Transactions, Vol. 94, 1986.

Notwithstanding this prior work, in order to meet strength requirements, gray iron castings for crank cases and cylinder heads were manufactured by alloying molten gray iron with chromium, but this caused hard spots in the casting due to chilling and iron carbide formation, which resulted in machining difficulties, damaged castings, and poor cutting-tool life and performance. In an effort to partially reduce the chilling tendency, silicon levels in the gray iron base and additions of a silicon-based inoculant were increased in the molten gray iron, which significantly increased the cost of manufacture. Furthermore, the additional silicon increased the need for a chromium strengthening alloy, which further increased costs and the tendency to form iron carbide hard spots and chills. In addition, as a result of the high level of alloying, solidification stresses in the resulting crank cases and cylinder heads were high, requiring stress relief heat treatment to minimize distortion and cracking of the castings during processing. Casting stresses were further increased by the need for the relatively low temperature shake-out, that is extraction from the mold, at temperatures of 900°–1200° F.

Thus, a need remained for a method of economical manufacturing for crank cases and cylinder heads using gray cast iron with a minimal formation of iron carbide hard spots and chills upon solidification, and a minimal need for stress relief heat treatment of the finishing casting.

BRIEF STATEMENT OF THE INVENTION

The method of the invention provides an economical method for manufacturing of gray cast iron crank cases and cylinder heads, having minimal iron carbide hard spots and chills upon solidification, and a minimal need for stress relief heat treatment of the finished casting. The method of the invention requires no additional processing equipment, and has the advantage of a short cooling time, that is, a hot shake-out temperature.

A method of the invention for the manufacture of crank cases and cylinder heads from gray cast iron includes the steps of providing a molten gray iron metal having a carbon equivalent of about 4.05%, comprised of about 3.4% to about 3.45% carbon, and about 1.80% to about 1.90% silicon with less than about 0.03% phosphorus, while maintaining sulfur of the molten gray iron metal at about 0.05% to about 0.07%, manganese at about 1.7 times the percentage of the sulfur plus about 0.30% to about 0.40%, and base iron chromium of less than about 0.10%. The molten gray iron base metal is transferred to a pouring ladle, and in the pouring ladle, the molten gray iron metal is alloyed with tin to a total tin content of about 0.05% to about 0.10%, to provide a molten tin-alloyed gray iron metal. The molten tin-alloyed gray iron metal is inoculated with the silicon-based inoculate to provide a further silicon addition of from about 0.10% to about 0.12%, and the resulting inoculated molten tin-alloyed gray iron metal is poured from the ladle into the casting molds as soon as possible, and preferably no later than 7–10 minutes after its inoculation.

In this method of manufacture, the molten gray iron metal has, compared with prior manufacturing methods, substantially increased carbon levels, lower levels of phosphorus, significantly lower levels of chromium, somewhat lower levels of sulfur, and, with the alloying use of tin as a pearlite stabilizer, substantially reduces the potential for iron carbide hard spots and chills, and allows significantly reduced silicon content in the gray iron and minimal inoculant additions. Further, the high shake-out temperatures for the resulting castings also minimizes the need for alloy addition and provides castings with lower residual stresses.

The method of manufacture of this invention results in castings much stronger that would be anticipated by its chemical composition, with charge material inoculation and alloying costs lower than conventional practice while minimizing the need for heat stress relief heat treatment of the resulting castings.

BRIEF DESCRIPTIONS OF THE DRAWINGS

FIG. 1 is a block diagram to illustrate the steps of the invention in the manufacture of gray iron castings.

DETAILED DESCRIPTION OF THE INVENTION

As illustrated in FIG. 1, the first step in the method of the invention is preparing a molten gray iron base metal having a controlled content. The molten gray iron metal is prepared in an electric furnace from scrap steel, gray iron ingots, and gray iron scrap recovered from the manufacturing process. The content of the molten gray iron metal is controlled by making spectrographic analyses of the scrap steel, gray iron ingots, and recovered gray iron scrap, adjusting the relative amounts of each of these three ingredients and, to the extent necessary, and supplementing the molten gray iron by the addition of one or more of silicon, phosphorus, manganese and chromium, as needed. Because of the general low levels of phosphorus, sulfur and chromium to be maintained in the molten gray iron metal, reduced amounts of these alloying metals are necessary, if any.

In the second step, the controlled content molten grey iron metal is placed in a pouring ladle for further processing. And in the third step, the controlled content molten grey iron metal is alloyed in the pouring ladle with tin, to a total tin content of about 0.05% to about 0.10%, sod more preferably 0.055% to about 0.095% depending upon the cross sections of the part being cast. The percentage of tin to be added to the controlled content grey iron metal in a third step depends upon the more important sections of the part being east. The important sections are those sections that must have the greatest strength and or machinability. An important section maybe either a thinner or thicker section of the casting, depending upon the Sanction of the section. The quantity of tin alloyed with the molten grey iron metal will be at the higher end of the about 0.05% to about 0.10% range, where the temperature of the important section drops more slowly (i.e., cools more slowly) and at the lower end of the range where the important section cools more quickly. Even a thinner section of a casting may require the addition of alloying sin at the higher end of the range if the temperature cools slowly as a result of adjacent heavy casting sections that act as heat sources for the thinner section.

In the fourth step of the method, the tin alloyed molten gray metal is inoculated with a silicon-based inoculants, to a silicon addition of between about 0.10% to about 0.12%. Silicon-based inoculants with barium and/or calcium are preferred in the practice of this invention. Parts are then cast as soon as possible, and preferably less than 7–10 minutes, after the inoculation of tin alloyed molten gray iron metal by pouring the contents of the ladle into one or more molds for the cast parts.

The cast parts are removed from the mold while they are at a temperature of over 1400° F., and preferably in the range of about 1500°–1600° F. The shake-out temperature of 1500°–1600° is preferred, but not critical to the invention, and the shake-out temperature may be determined by removal of cast parts from the molds after a specified cooling time interval, which has been empirically determined to result in casting part temperatures of over 1400° F. and preferably in the range of about 1500°–1600° F. Because of the relatively high shake-out temperatures, processing times for the castings are reduced.

Use of the invention in casting engine blocks and crank cases minimizes the hard spots in the cast product resulting from iron carbides and chills, which interfere with the machinability of the part, and provides a more uniform, pearlite structure in the casting, providing increased strengths.

While the invention has been described as used in the manufacture of engine blocks and crank cases, those skilled in the art will recognize that the invention can include deviations from the described preferred embodiment, permitting its use in casting other parts, without departing from the claimed invention.

What is claimed is:

1. A method for the manufacture of crank cases and cylinder heads from grey cast iron comprising the steps of:

providing a molten controlled-content grey iron metal having a carbon equivalent of about 4.05%, comprised of about 3.40% to about 3.45% carbon, about 1.80% to about 1.90% silicon with less than about 0.03% phosphorus, while maintaining base iron sulfur at about 0.05% to about 0.07%, manganese at about 1.7 times the percentage of sulfur plus about 0.30% to about 0.40%, and base iron chromium less than about 0.10%;

transferring said molten controlled-content grey iron metal to a pouring ladle;

alloying said molten controlled-content grey iron metal with tin in said pouring ladle to a total tin content of about 0.05% to about 0.10% to provide a molten tin-alloyed, controlled-content grey iron metal;

inoculating said molten tin-alloyed, controlled-content grey iron metal with a grey iron inoculant to a further silicon addition of from about 0.10% to about 0.12%;

pouring said molten, tin-alloyed, inoculated controlled-content grey iron metal as soon as possible after said inoculation into a casting mold; and shaking out the resulting casting out of the casting mold while at a temperature over 1400° F.

2. The method of claim 1 wherein the step of providing the molten controlled content grey iron metal comprises determining the carbon, silicon, phosphorus, sulfur, manganese and chromium contents of scrap steel, grey iron ingots, and recovered grey iron scrap material;

melting the scrap steel, grey iron ingots, and recovered grey iron scrap material in relative proportions to approximate the molten controlled content grey iron metal; and adjusting the carbon, silicon, phosphorus, sulfur, manganese and chromium contents of the approximated molten controlled content grey iron metal to the extent necessary to provide the molten controlled content grey iron metal.

3. The method of claim 1 wherein the molten controlled-content grey iron metal is alloyed with tin in a percentage dependent on an important section of the part being cast that is required to have greatest strength and/or machinability.

4. The method of claim 3 wherein the molten controlled-content grey iron metal is alloyed with tin at the high end of the percentage range for parts with an important section that cools slowly.

5. The method of claim 3 wherein the molten controlled-content grey iron metal is alloyed with tin at the low end of the percentage range for parts with an important section that cools quickly.

6. A method for casting internal combustion engine parts with grey cast iron, comprising the steps of:

providing a molten grey iron metal having a carbon equivalent of about 4.05%, comprised of about 3.40% to about 3.45% carbon, about 1.80% to about 1.90% silicon with less than about 0.03% phosphorus, base iron sulfur of about 0.05% to about 0.07%, manganese of about 1.7 times the percentage of sulfur plus about 0.30% to about 0.40%, and base iron chromium less than about 0.10%;

alloying said molten grey iron metal prior to pouring with tin to a total tin content of about 0.05% to about 0.10% to provide a molten tin-alloyed grey iron metal;

inoculating said molten tin-alloyed grey iron metal prior to pouring with a grey iron inoculant to a further silicon addition of from about 0.10% to about 0.12%; and casting an internal combustion engine part as soon as possible after said inoculation.

7. The method of claim 6 wherein the step of providing the molten grey iron metal comprises determining the carbon, silicon, phosphorous, sulfur, manganese and chromium contents of scrap steel, grey iron ingots, and recovered grey iron scrap material, melting the scrap steel, grey iron ingots and recovered grey iron scrap in relative proportions to approximate the molten controlled content grey iron metal; and adjusting the carbon, silicon, phosphorous, sulfur, manganese and chromium contents of the approximated molten controlled content grey iron metal to the extent necessary to provide the molten controlled content grey iron metal.

8. The method of claim 6 wherein the molten grey iron metal is alloyed with tin in a percentage dependent on an important section of the internal combustion engine part being cast that is required to have greatest strength and/or machinability.

9. The method of claim 8, wherein the molten grey iron metal is alloyed with tin at the high end of the percentage range for internal combustion engine parts with an important section that cools slowly.

10. The method of claim 8 wherein the molten grey iron metal is alloyed with tin at the low end of the percentage range for internal combustion engine parts with an important section that cools quickly.

11. The method of claim 6 further comprising removing the cast part from its mold while it is in excess of 1400° F.

12. A method for casting internal combustion engine parts, comprising, preparing a molten grey iron metal for pouring that comprises a carbon equivalent of about 4.05% with about 3.40% to about 3.45% carbon and about 1.80% to about 1.90% silicon with less than about 0.03% phosphorus, base iron sulfur of about 0.05% to about 0.07%, manganese of about 1.7 times the percentage of sulfur plus about 0.30% to about 0.40%, base iron chromium less than about 0.10%, and tin of about 0.05% to about 0.10%, by the steps of transferring the molten grey iron metal, absent the tin, to a pouring ladle, adding tin to the molten grey iron metal in said pouring ladle to said content of about 0.05% to about 0.10%, and thereafter inoculating the molten grey iron metal with an inoculant to a further silicon addition of from about 0.10% to about 0.12%;

pouring the molten grey iron metal as soon as possible after said inoculation into a casting mold; and shaking the resulting casting out of the casting mold while at a temperature over 1400° F.

13. The method of claim 12 wherein the resulting casting includes an important section that cools slowly and the molten grey iron metal, when poured, has a total tin content of about 0.10%.

14. The method of claim 12 wherein the resulting casting includes an important section that cools quickly and the molten grey iron metal, when poured, has a total tin content of about 0.05%.

* * * * *